US007062868B2

(12) United States Patent
Frulla

(10) Patent No.: US 7,062,868 B2
(45) Date of Patent: Jun. 20, 2006

(54) PROTECTIVE TOECAP, PARTICULARLY FOR SAFETY SHOES

(75) Inventor: Claudio Frulla, Lacchiarella (IT)

(73) Assignee: Esjotech S.r.l. (IT)

( * ) Notice: Subject to any disclaimer, the term of this patent is extended or adjusted under 35 U.S.C. 154(b) by 0 days.

(21) Appl. No.: 10/493,988

(22) PCT Filed: Oct. 24, 2002

(86) PCT No.: PCT/EP02/11917

§ 371 (c)(1),
(2), (4) Date: Sep. 14, 2004

(87) PCT Pub. No.: WO03/037127

PCT Pub. Date: May 8, 2003

(65) Prior Publication Data

US 2005/0016024 A1 Jan. 27, 2005

(30) Foreign Application Priority Data

Oct. 29, 2001 (IT) ..... MI2001A2270

(51) Int. Cl.
*A43C 13/14* (2006.01)

(52) U.S. Cl. ..... 36/77 R; 36/77 M

(58) Field of Classification Search ..... 36/77 R, 36/77 M, 72 R

See application file for complete search history.

(56) References Cited

U.S. PATENT DOCUMENTS

| | | | | |
|---|---|---|---|---|
| 1,703,562 A | | 2/1929 | Williams | |
| 4,995,174 A | * | 2/1991 | Hong et al. | 36/72 R |
| 5,666,745 A | * | 9/1997 | Harwood | 36/77 R |
| 5,809,666 A | * | 9/1998 | Harwood | 36/77 R |
| 6,907,681 B1 | * | 6/2005 | Tanaka et al. | 36/77 R |

FOREIGN PATENT DOCUMENTS

| | | | |
|---|---|---|---|
| EP | 0100181 | * | 2/1984 |
| EP | 0 423 447 A | | 4/1991 |
| EP | 0 812 551 A | | 12/1997 |
| GB | 2138272 | * | 11/1983 |
| JP | 07227302 | | 8/1995 |

* cited by examiner

*Primary Examiner*—M.D. Patterson
(74) *Attorney, Agent, or Firm*—Fish & Richardson P.C.

(57) ABSTRACT

A protective toecap particularly for safety shoes, which has the particularity that it comprises a body (1) made of aluminum alloy with an elongation coefficient of more than 15%. The body (1) delimits a space with a rear opening and a lower opening and forms an upper portion (2) that blends with a substantially vertical rim (3) that affects the front portion (3*a*) and lateral portions (3*b*) that mutually diverge. There is also a lower rim (4), which delimits the lower opening and is connected to the lower end (3*a*) of the front portion and of the lateral portions (3*b*).

10 Claims, 2 Drawing Sheets

PROTECTIVE TOECAP, PARTICULARLY FOR SAFETY SHOES

This application is a 371 of PCT/EP02/11917 filed Oct. 24, 2002.

TECHNICAL FIELD

The present invention relates to a protective toecap, particularly for safety shoes.

BACKGROUND ART

It is known that protective toecaps for safety shoes are currently commercially available which, in most cases, are made of hardened steel with a thickness of approximately 1.6–1.7 mm. Said toecaps are produced by forming from a plate and therefore necessarily have a substantially constant thickness and require protective coating.

Steel toecaps have, for an average shoe size, a weight of approximately 180–190 g per pair.

The typical drawbacks of these toecaps arise mainly from their weight and from the fact that they can be subject to corrosion; they also have an is intense magnetism.

In order to try to solve the problems linked to steel toecaps, toecaps made of composite material, such as fiberglass-reinforced plastics with reinforcing elements, have already been provided; they have the advantage of a significant weight reduction with respect to steel toecaps and of total lack of magnetism and electrical conductivity, but on the other hand they have a very high cost and considerable aesthetic problems on the shoe, owing to the considerable thickness required in order to pass the tests prescribed by the standards.

Another problem, moreover, arises from the fact that it is necessary to modify the molds used by safety shoe manufacturing industries so as to allow to accommodate said toecap. Moreover, the composite material is significantly prone to deterioration over time.

DISCLOSURE OF THE INVENTION

The aim of the present invention is to eliminate the above noted drawbacks, by providing a protective toecap particularly for safety shoes that allows to obtain a structure that is sufficiently light but at the same time does not require the great thicknesses that are typical of composite material.

Within this aim, an object of the invention is to provide a protective toecap that cannot be altered over time, is not subject to corrosion, is not magnetic, and furthermore does not alter the typical styling of shoes.

Another object of the present invention is to provide a protective toecap which, by virtue of its particular constructive characteristics, is capable of giving the greatest assurances of reliability and safety in use.

Another object of the present invention is to provide a protective toecap that can have a very low cost, thus facilitating its diffusion among users.

This aim and these and others object that will become better apparent hereinafter are achieved by a protective toecap particularly for safety shoes, according to the invention, characterized in that it comprises a body made of aluminum alloy with an elongation coefficient of more than 15%, said body delimiting a space with a rear opening and a lower opening and forming an upper portion that blends with a rim, which is substantially vertical with respect to the plane of use of the shoe and affects the front portion and lateral portions that are mutually different, a lower rim being further provided which delimits said lower opening and is connected to the lower end of said front portion and of said lateral portions.

BRIEF DESCRIPTION OF THE DRAWINGS

Further characteristics and advantages will become better apparent from the detailed description of a protective toecap particularly for safety shoes according to the invention, illustrated only by way of non-limitative example in the accompanying drawings, wherein.

WAYS OF CARRYING OUT THE INVENTION

Figure 1:
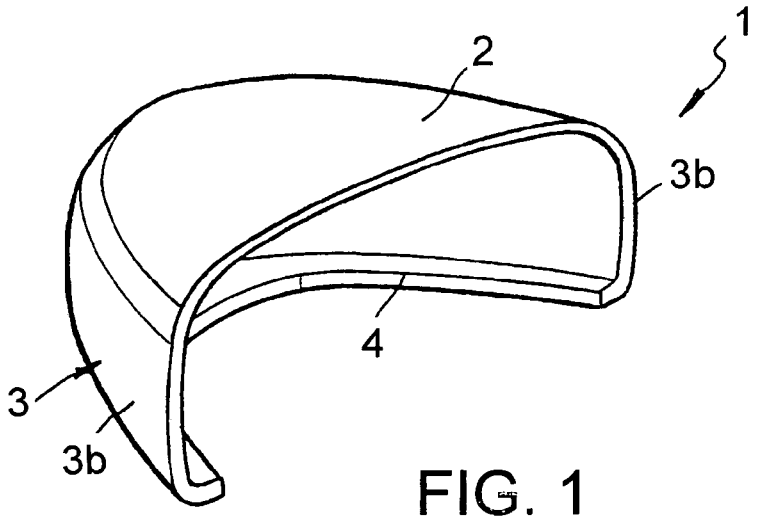
FIG. 1 is a schematic perspective view of the toecap according to the invention.
Figure 2:
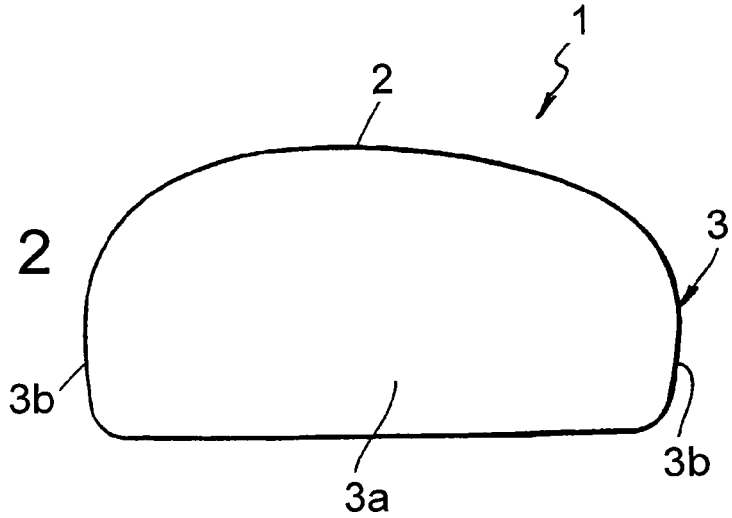
FIG. 2 is a front view of the toecap.
Figure 3:
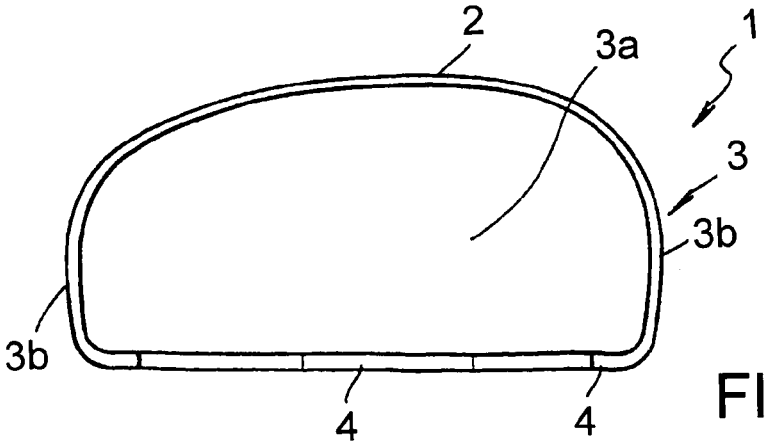
FIG. 3 is a rear elevation view of the toecap.
Figure 4:
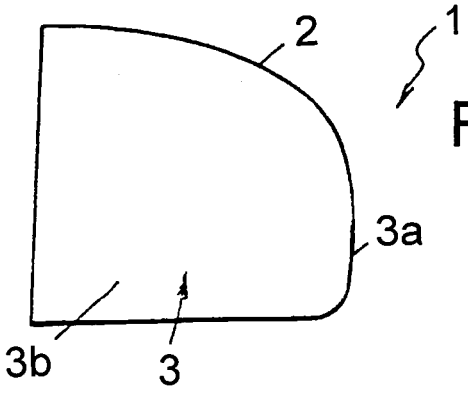
FIG. 4 is a side elevation view of the toecap.
Figure 5:
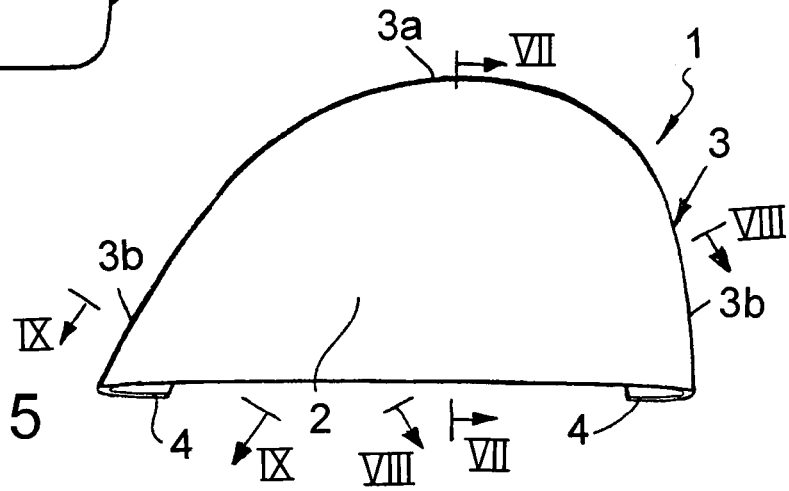
FIG. 5 is a top plan view of the toecap.
Figure 6:
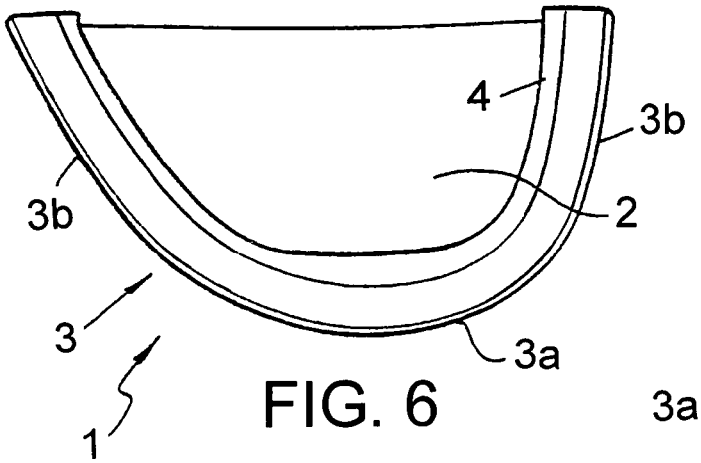
FIG. 6 is a bottom plan view of the toecap.
Figure 7:
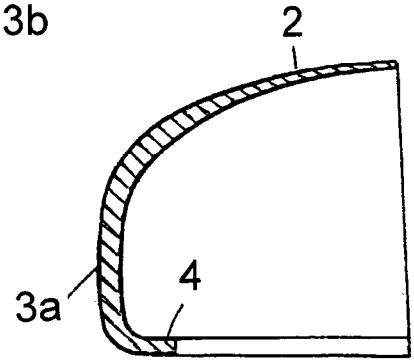
FIG. 7 is a sectional view of the toecap, taken along the line VII—VII of FIG. 5.
Figure 8:
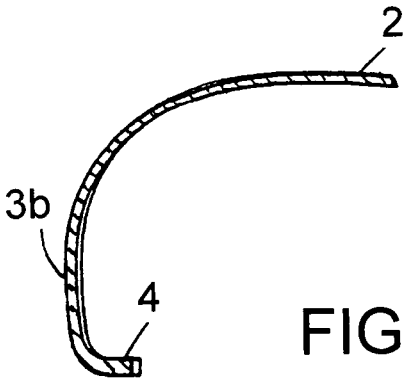
FIG. 8 is a sectional view of the toecap, taken along the line VIII—VIII of FIG. 5.
Figure 9:
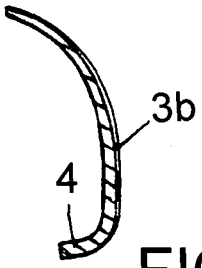
FIG. 9 is a sectional view of the toecap, taken along the line IX—IX of FIG. 5.

With reference to the figures, the protective toecap particularly for safety shoes, according to the invention, comprises a body, generally designated by the reference numeral 1, which is made of aluminum alloy and has the particularity of having different thicknesses in the various parts that compose it, so as to optimize its resistance to crushing and allow to use is reduced thicknesses.

The body 1 is obtained by way of a casting method which is, for example, of the type disclosed in PCT/EP02/04812 filed May 2, 2002, assumed included herein by reference.

The provision of an aluminum protective toecap has required the execution of various tests using alloys having different characteristics.

Initially, an alloy with a high ultimate tensile strength, approximately 530–630 MPa, with a yield strength of 450–560 MPa and a Brinell hardness of 145–170 Hb, was used.

This alloy, which has an elongation coefficient of 5–10%, was made for example of aluminum alloy with 1.6% Cu, up to 0.30% Fe, up to 0.6% Si, 2.5% Mg, 0.20% Mn, 5.8% Zn, 0.15% Cr, 0.08% Ti.

The thicknesses used were 2.2–2.8 mm.

When a specimen was subjected to the impact test, as required by European specifications, with an impact of 200 joules, a fracture was noted in the impact region; such a fracture is of course not allowed by the tests.

In order to overcome this drawback, an alloy with an ultimate tensile strength of 480–520 MPa, a yield strength of 360–450 MPa, a Brinell hardness of 110/125% Hb and an elongation of 10–14% was used.

The alloy used aluminum with 4.4% Cu, up to 0.5% Fe, up to 0.5% Si, 1.6% Mg, 0.8% Mn, up to 0.1% Zn, up to 0.1% Ti, and up to 0.1% Cr.

The toecaps produced in various thicknesses with this aluminum alloy again exhibited a fracture, albeit a smaller one than in the preceding case, when subjected to the impact test.

In order to solve the problem, an alloy was chosen which has a very high value of elongation after heat treatment, i.e., an elongation of more than 15%, preferably 20–21%.

The alloy had an ultimate tensile strength of 400–420 MPa, a yield strength of 250–270 MPa, and a Brinell hardness of 110/115 Hb.

The alloy was made of aluminum, with up to 0.13% Si, up to 0.2% Fe, is 4.5% Cu, 0.04% Mn, 0.3% Mg, 0.04% Ni, 0.09% Zn, 0.2% Ti.

When the toecaps were subjected to the impact test, it was found that none of the tested toecaps exhibited fractures, and deformation was found to be within the limits set by the standards.

The toecaps were produced with a thickness varying from 1.2 to 3.7 mm, and have a weight per toecap pair of average size, for example US size 9 or European size 43, of 95 to 110 g.

In the provision of the toecap, the body 1 was studied so as to delimit a space with a rear opening and a lower opening. The body 1 has an upper portion 2, which blends with a rim 3 that lies substantially on the vertical plane with respect to the plane of use of the shoe.

The rim 3 affects the front portion 3*a*, and has lateral portions 3*b* that mutually diverge.

There is also a lower rim 4, which delimits the downward opening of the toecap and is connected to the lower end of the front portion 3*a* and of the lateral portions 3*b*.

As regards thicknesses, it has been found optimum to use, for the front portion 3*a*, thicknesses between 3.4 and 3.7 mm, preferably 3.5 mm, which gradually taper so as to have, at the upper portion 2, a continuous decrease in thickness up to a free edge that has a thickness of 1.2–1.4 mm, preferably 1.3 mm.

Blending between the front portion and the upper portion occurs by means of a front curved portion, in which the thickness reaches its maximum value and then tapers.

The lateral portions 3*b*, which blend with the front portion 3*a*, also have a thickness that tapers until it reaches, at the free edge, a thickness that can be estimated at 1.6–1.8 mm, preferably 1.7 mm.

The lower rim, which has a width of 10 to 12 mm, preferably 11 mm, has a thickness of 2.2 to 2.6 mm, preferably 2.5 mm.

By using these thicknesses, the possibility has been achieved to manufacture a toecap that has a very low weight and an impact test resistance that is optimum and therefore fully compliant with applicable standards.

Furthermore, another important aspect is constituted by the fact that the toecap, thanks to the adoption of the differentiated thicknesses, is able to reduce its weight, since it is possible to reduce the thicknesses in the regions that are not particularly stressed and increase them in the stressed regions.

The resulting toecap has thicknesses that are fully comparable to those of steel toecaps, so that it is not necessary to alter the shape of the shoes, and one also obtains a plurality of advantages since aluminum alloys are typically noncorrodable and do not deteriorate over time.

It should also be noted that it is particularly important to have selected an alloy that privileges the elongation coefficient, even to the detriment of ultimate tensile strength, thus subverting the conventional criteria that would lead, in order to have greater impact strength, to the choice of an alloy having a high ultimate tensile strength.

The invention thus conceived is susceptible of numerous modifications and variations, all of which are within the scope of the appended claims.

All the details may further be replaced with other technically equivalent elements.

In practice, the materials used, as well as the contingent shapes and dimensions, may be any according to requirements.

The disclosures in Italian Patent Application No. MI2001A002270 from which this application claims priority are incorporated herein by reference.

The invention claimed is:

1. A protective toecap particularly for safety shoes, characterized in that it comprises a body made of casted aluminum alloy with an elongation coefficient of more than 15%, said body delimiting a space with a rear opening and a lower opening and forming an upper portion that blends with a rim, which is substantially vertical with respect to the plane of use of the shoe and affects the front portion and lateral portions that mutually diverge and characterized in that said upper portion and lateral portions have differentiated thickness, a lower rim being further provided which delimits said lower opening and is connected to the lower end of said front portion and of said lateral portions.

2. The protective toecap particularly for safety shoes, characterized in that it comprises a body made of aluminum alloy, which delimits a space with a rear opening and a lower opening and forms an upper portion which has a free edge toward said rear opening with a thickness between 1.2 and 1.4 mm and blends with a substantially vertical rim that affects a front portion, with a thickness between 3.4 and 3.7 mm, and lateral portions with a thickness that tapers from said front portion to a thickness of 1.6 to 1.8 mm, a lower rim being further provided which has a thickness between 2.2 and 2.6 mm, delimits said lower opening and is connected to the lower end of said front portion of said lateral portions.

3. The protective toecap of claim 1 or 2, characterized in that said aluminum alloy has an elongation coefficient of substantially 20–21%.

4. The protective toecap according to claim 1 or 2, characterized in that said aluminum alloy has an ultimate tensile strength of 400–420 MPa, a yield strength of 250–270 MPa, and a Brinell hardness of 110–115 Hb.

5. The protective toecap according to claim 1 or 2, characterized in that said alloy comprises, in combination with the aluminum, less than 0.13% Si, less than 0.2% Fe, substantially 4.5% Cu, substantially 0.04% Mn, substantially 0.03% Mg, substantially 0.04% Ni, substantially 0.09% Zn, and substantially 0.2% Ti.

6. The protective toecap according to claim 1 or 2, characterized in that said upper portion has a maximum thickness at the front and upper part for blending with said front portion and tapers up to the edge directed toward said rear opening.

7. The protective toecap according to claim 1 or 2, characterized in that said front portion has a thickness of 3.5 mm.

8. The protective toecap according to 1 or 2, characterized in that the free edge of said lateral portions that is directed toward said rear opening has a thickness of 1.7 mm.

9. The protective toecap according to claim 1 or 2, characterized in that the free edge of said upper portion has a thickness of 1.3 mm.

10. The protective toecap according to claim 1 or 2, characterized in that said lower rim has a thickness of 2.5 mm.

* * * * *

UNITED STATES PATENT AND TRADEMARK OFFICE

CERTIFICATE OF CORRECTION

PATENT NO. : 7,062,868 B2
APPLICATION NO. : 10/493988
DATED : June 20, 2006
INVENTOR(S) : Claudio Frulla It is certified that error appears in the above-identified patent and that said Letters Patent is hereby corrected as shown below:

In Column 4, claim 8, line 57 after "to" insert -- claim -- before "1 or 2".

Signed and Sealed this

First Day of May, 2007

JON W. DUDAS
*Director of the United States Patent and Trademark Office*